US012759779B2

(12) United States Patent
Lukacs et al.

(10) Patent No.: US 12,759,779 B2
(45) Date of Patent: Oct. 13, 2026

(54) MEDICAL KIT PACKAGE AND PRODUCT MARRYING PROCESS

(71) Applicant: TELEFLEX MEDICAL LLC, Morrisville, NC (US)

(72) Inventors: Brandon Lukacs, Fuquay Varina, NC (US); Michael Schnoor, Sinking Spring, PA (US)

(73) Assignee: TELEFLEX MEDICAL LLC, Morrisville, NC (US)

( * ) Notice: Subject to any disclaimer, the term of this patent is extended or adjusted under 35 U.S.C. 154(b) by 0 days.

(21) Appl. No.: 18/598,520

(22) Filed: Mar. 7, 2024

(65) Prior Publication Data

US 2024/0208708 A1 Jun. 27, 2024

Related U.S. Application Data

(63) Continuation of application No. PCT/US2022/042895, filed on Sep. 8, 2022.

(Continued)

(51) Int. Cl.
*B65D 75/32* (2006.01)
*B65B 5/10* (2006.01)

(Continued)

(52) U.S. Cl.
CPC ..... *B65D 75/327* (2013.01); *B65B 5/10* (2013.01); *B65B 7/2878* (2013.01); *B65B 51/10* (2013.01);

(Continued)

(58) Field of Classification Search
CPC ..... B65D 75/327; B65D 2575/3245; B65B 5/10; B65B 7/2878; B65B 51/10;

(Continued)

(56) References Cited

U.S. PATENT DOCUMENTS 3,954,174 A * 5/1976 Kraus ..... A61B 50/30 206/439
4,819,412 A * 4/1989 Sengewald ..... B65B 9/04 53/485

(Continued)

FOREIGN PATENT DOCUMENTS

CH 716642 A1 3/2021
CN 105307949 A 2/2016

(Continued)

OTHER PUBLICATIONS

Extended European Search Report for EP Application No. 22868053.4, dated Jun. 26, 2025.

*Primary Examiner* — Dariush Seif
(74) *Attorney, Agent, or Firm* — BakerHostetler

(57) ABSTRACT

A package for a medical kit and a product marrying process are provided. The package has a tray including a first compartment proximate to a first end of the tray, a second compartment proximate to a second end of the tray, and a rim surrounding the first and second compartments. A flexible cover sheet is sized to cover the first and second compartments of the tray. The cover sheet is heat-sealed to the rim during a first sealing process in which a primary seal is formed to seal the first compartment of the tray, such that access to the second compartment still remains available. The cover sheet is further heat-sealed to the rim during a second sealing process in which a secondary seal is formed along the second end of the tray such that the secondary seal complements the primary seal to seal the second compartment of the tray.

8 Claims, 7 Drawing Sheets

Related U.S. Application Data

(60) Provisional application No. 63/242,821, filed on Sep. 10, 2021.

(51) Int. Cl.
*B65B 7/28* (2006.01)
*B65B 51/10* (2006.01)

(52) U.S. Cl.
CPC .. *B65B 2220/14* (2013.01); *B65D 2575/3245* (2013.01)

(58) Field of Classification Search
CPC ..... B65B 2220/14; A61B 2050/3008; A61B 50/33; A61B 50/30; A61M 25/002; A61M 25/00; A61M 25/0017
See application file for complete search history.

(56) References Cited

U.S. PATENT DOCUMENTS 4,880,111 A * 11/1989 Bagwell ..... B65D 81/3266 206/362.2
5,054,610 A * 10/1991 Ajello ..... G02C 13/008 206/5.1
5,163,557 A * 11/1992 Sokolowski ..... A61B 50/33 206/439
5,277,920 A * 1/1994 Weaver, Jr. ..... B65D 81/3294 222/541.6
5,408,804 A * 4/1995 Schroder ..... B65B 55/04 53/240
5,603,572 A * 2/1997 Shmois ..... H05B 6/645 422/26
6,591,783 B1 * 7/2003 Lajeunesse ..... A01K 63/02 119/201
7,578,391 B2 * 8/2009 Nakamura ..... A61B 50/33 206/572
8,376,177 B2 * 2/2013 Castner ..... B65D 45/00 206/561
8,584,853 B2 * 11/2013 Knight ..... A61L 2/26 206/439
8,807,373 B1 * 8/2014 Russell ..... A47G 23/06 220/359.1
9,101,349 B2 * 8/2015 Knight ..... A61B 17/0642
9,204,932 B2 * 12/2015 Knight ..... A61B 50/30
9,790,015 B2 * 10/2017 Richart ..... B65D 75/327
9,802,744 B2 * 10/2017 Huffer ..... B65D 75/5855
10,232,983 B2 * 3/2019 Mobarhan ..... B65D 81/3453
11,090,095 B2 * 8/2021 Knight ..... B65D 85/00
2002/0108955 A1 * 8/2002 Erb ..... B65D 77/2024 220/359.4
2003/0075474 A1 * 4/2003 Moyer ..... A61B 50/33 206/570
2004/0200754 A1 * 10/2004 Hagemeier ..... A61B 50/30 206/570
2005/0189252 A1 9/2005 Naylor et al.
2006/0180483 A1 * 8/2006 Sekendur ..... B65D 51/246 206/216
2006/0283728 A1 * 12/2006 Patrick ..... B65D 75/5855 206/229
2007/0095679 A1 * 5/2007 Nakamura ..... A61B 50/30 206/210
2008/0230298 A1 * 9/2008 Buch ..... A61P 1/02 180/311
2009/0149527 A1 * 6/2009 Timm ..... A61K 31/407 206/572
2009/0152148 A1 * 6/2009 Scheurer ..... A61B 50/3001 206/365
2010/0062130 A1 * 3/2010 Finley ..... B65D 81/3294 426/531
2011/0127188 A1 6/2011 Thompson et al.
2011/0318457 A1 * 12/2011 Daniel ..... B65D 81/3294 426/115
2012/0152954 A1 * 6/2012 Bruehl ..... B65D 77/2052 220/265
2012/0241336 A1 * 9/2012 Finley ..... B65D 81/3294 206/219
2012/0267272 A1 * 10/2012 Agrawal ..... A61B 50/30 206/439
2013/0118116 A1 * 5/2013 Brannan ..... B65D 81/3294 53/443
2013/0122138 A1 * 5/2013 Chappell, Jr. ..... A23L 35/00 426/135
2014/0346071 A1 * 11/2014 Genosar ..... A61J 1/2093 206/438
2015/0266665 A1 * 9/2015 Flick ..... A47J 31/407 426/115
2016/0095663 A1 * 4/2016 Richart ..... B65D 75/327 206/438
2016/0130538 A1 5/2016 Cooley et al.
2018/0339807 A1 * 11/2018 Mobarhan ..... A47G 23/06
2020/0002073 A1 * 1/2020 Wood ..... B65B 11/50
2021/0094745 A1 * 4/2021 White ..... B65B 31/025
2021/0155507 A1 * 5/2021 Kamen ..... B65B 3/003
2021/0308673 A1 * 10/2021 Chiu ..... B01L 3/502715
2022/0111102 A1 * 4/2022 Fauconnier ..... A61L 9/12
2022/0354635 A1 * 11/2022 Dockhorn ..... A61B 50/20
2024/0208708 A1 * 6/2024 Lukacs ..... B65B 7/2878
2026/0130793 A1 * 5/2026 Lerner ..... A61F 9/0017

FOREIGN PATENT DOCUMENTS

CN 214113589 U 9/2021
DE 29608617 U1 8/1996
EP 2450292 A1 5/2012
WO 2021/062568 A1 4/2021

* cited by examiner

MEDICAL KIT PACKAGE AND PRODUCT MARRYING PROCESS

CROSS-REFERENCE TO RELATED APPLICATIONS

This application is a continuation of International Patent Application No. PCT/US2022/042895, filed Sep. 8, 2022, which claims priority to U.S. Provisional Patent Application No. 63/242,821, filed Sep. 10, 2021, the contents of which are hereby incorporated herein in their entirety.

FIELD OF THE INVENTION

The present invention generally relates to a package for a medical kit, and a product marrying process for packaging components of the medical kit.

BACKGROUND

Medical devices are commonly packaged in molded plastic trays having compartments and indentations for securely holding the various parts of each medical device. Medical device packages are typically heat-sealed with a thin flexible lid having an adhesive backing, and sterilized with the device contained in the package. Conventional lids are often made from a polymeric sheet material that provides a breathable sterile barrier. Such lids may be coated on one side with a heat sealable coating, such as a hot melt adhesive. Raised surfaces are sometimes formed around the periphery of the tray to provide a surface for heat sealing the lid onto the tray.

Tabs may be formed in the lid so that the lid can be easily grasped and peeled open by a user when access to the medical device is needed. There are times when it is desirable to peel or tear open only a portion of the lid to gain access to a portion of the medical device while retaining the sterility of the other portion of the device. Some lids have been provided with a first tab for peeling open a first portion of the lid to expose one compartment of the package, and a second tab for peeling open a second portion of the lid to expose the other compartment of the package. In practice, however, the portion of the lid the user intends to peel open over a first sterile compartment sometimes tears an adjacent portion of the lid over a second sterile compartment, thus unintentionally exposing the second sterile compartment and risking contamination of the medical device stored therein. Moreover, any shredding of the lid may result in loose particulate matter entering the compartment, thus further increasing the likelihood of contamination.

Moreover, conventional sterile barrier packaging systems are sealed to prevent ingress of microbes post-sterilization. This type of seal is a one-time use seal, and therefore cannot be opened and re-sealed. Thus, a major disadvantage of conventional one-time use seals is that they do not allow for a marrying process to be carried out in which a product is packaged and sealed at one facility, and then additional components are added at a second facility, or at a separate time during the filling process.

Accordingly, there is a clear and substantial need for a new and improved packaging system for a product marrying process. It is therefore an object of the present invention to provide a dual cavity tray for a medical procedure kit, where the dual cavity or pocket package has a modified seal design for sealing the lidding to a rigid or flexible tray such that the shape of the seal design leaves a single side of the package unsealed for quick and easy access to one of the cavities.

Another object of the present invention is to provide a seal design that stops short of the tray edge to create a flap for ease of opening on both ends of the tray so that a user can open the package from either end. Further, the dual cavity package and modified seal allows components to be added into a secondary cavity and sealed at a secondary facility or at different time during the packing process. Thus, the present invention allows a primary product to be loaded in a tray that maintains its original seal when packaging a secondary product without requiring additional packaging components, such as those which hang off the originally sealed tray. The present invention also allows for secondary processing prior to sterilization. Additionally, the present invention allows for sterilizing a portion of the product while keeping the secondary cavity non-sterile.

SUMMARY

The foregoing needs are met, to a great extent, by the present invention of a medical kit package and a product marrying process. The package for a medical kit comprises a tray including a first compartment proximate to a first end of the tray, a second compartment proximate to a second end of the tray, and a rim surrounding the first and second compartments; a flexible cover sheet configured to removably cover the first and second compartments of the tray; a primary seal formed between the rim and the cover sheet during a first sealing process to seal the first compartment of the tray; and a secondary seal formed between the rim and the cover sheet on the second end of the tray during a second sealing process, where the secondary seal complements the primary seal to seal the second compartment of the tray.

According to another aspect of the present invention, the primary seal is formed on the rim at a first side of the tray and extends from the first end of the tray to the second end of the tray, and wherein the primary seal is further formed on the rim at the second side of the tray and extends from the first end of the tray to the second end of the tray.

According to another aspect of the present invention, the primary seal is formed on the rim at the first end of the tray and extends from the first side of the tray to the second side of the tray.

According to another aspect of the present invention, the second compartment of the tray is adjacent to the first compartment of the tray.

According to another aspect of the present invention, the tray further includes a land section disposed between the first compartment and the second compartment, the land section separating the first and second compartments.

According to another aspect of the present invention, the land section extends from a portion of the rim at a first side of the tray to a portion of the rim at a second side of the tray.

According to another aspect of the present invention, the primary seal is formed on the land section extending from the portion of the rim at the first side of the tray to the portion of the rim at the second side of the tray.

According to another aspect of the present invention, the secondary seal is formed on the rim at the second end of the tray and extends from a first side of the tray to a second side of the tray.

According to another aspect of the present invention, the first compartment is configured to receive a first component at a first processing location prior to the first sealing process.

According to another aspect of the present invention, the component includes a medical device.

According to another aspect of the present invention, the second compartment is configured to receive a second component at a second processing location after the first sealing process.

According to another aspect of the present invention, the second component includes a medication container.

According to another aspect of the present invention, the rim of the tray includes an outwardly extending flange.

According to another aspect of the present invention, a first edge at the first end of the tray is unsealed after the primary seal is formed such that a first edge of the cover sheet forms a first unsealed flap over the corresponding first edge of the tray.

According to another aspect of the present invention, a second edge at the second end of the tray is unsealed after the secondary seal is formed such that a second edge of the cover sheet forms a second unsealed flap over the corresponding second edge of the tray.

According to another aspect of the present invention, a corner of the rim is chamfered.

According to another aspect of the present invention, the package further comprises a tack seal between the cover sheet and the rim at the second end of the tray.

According to another aspect of the present invention, the first compartment includes a first recessed cavity having a rectangular shape.

According to another aspect of the present invention, the first compartment includes a first recessed cavity having a square shape.

According to another aspect of the present invention, a product marrying process comprises: providing a tray at a first processing location, the tray including a first compartment proximate to a first end of the tray, a second compartment proximate to a second end of the tray, and a rim surrounding the first and second compartments; filling the first compartment of the tray with a first component; placing a flexible cover sheet over the first and second compartments of the tray; forming a primary seal between the cover sheet and the tray by heat-sealing the cover sheet to the rim of the tray such that the first compartment is sealed by the primary seal and the second compartment is partially sealed by the primary seal; sending the tray to a second processing location; filling the second compartment of the tray with a second component; and forming a secondary seal between the cover sheet and the tray by heat-sealing the cover sheet to the rim at the second end of the tray such that the secondary seal complements the primary seal to seal the second compartment.

Thus, in accordance with the present invention, a dual cavity tray with a partially closed H-seal design allows two components or products to be packaged into the same packaging system at separate locations and times. Such a seal design may also be referred to as a legged seal, a dual-cavity legged seal, or an extended bar seal, among others. This packaging system reduces the need for additional external packaging adhered over the outside of the dual cavity tray in order to add a second component, and instead maintains the tray as a single unit. It is useful to a manufacturer to be able to sterilize both components at the same time as a single unit. It is also useful to allow the primary compartment to be sealed and the secondary compartment to be filled with a non-sterile component after the initial sterilization process has been performed. The design is also useful for an end user since it allows for opening one lid of the package to expose both components. The design also creates an opening flap allowing the consumer more surface area to grip the tray and lidding when opening the package.

There has thus been outlined certain embodiments of the present invention in order that the detailed description thereof herein may be better understood, and in order that the present contribution to the art may be better appreciated. There are additional embodiments of the present invention that will be described below and which form the subject matter of the claims appended hereto.

In this respect, before explaining at least one aspect of the present invention in detail, it is to be understood that the medical kit package and the product marrying process are not limited in their application to the details of construction and to the arrangements of the components set forth in the following description or illustrated in the drawings. The medical kit package and the product marrying process are capable of aspects in addition to those described, and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this invention is based may readily be utilized as a basis for the designing of other structures, methods, and systems for carrying out the several purposes of the present invention. It is important, therefore, that the claims be regarded as including such equivalent constructions insofar as they do not depart from the spirit and scope of the invention.

BRIEF DESCRIPTION OF THE DRAWINGS

In order that the present invention may be readily understood, aspects of the medical kit package and product marrying process are illustrated by way of examples in the accompanying drawings, in which like parts are referred to with like reference numerals throughout.

DETAILED DESCRIPTION

Figure 1:
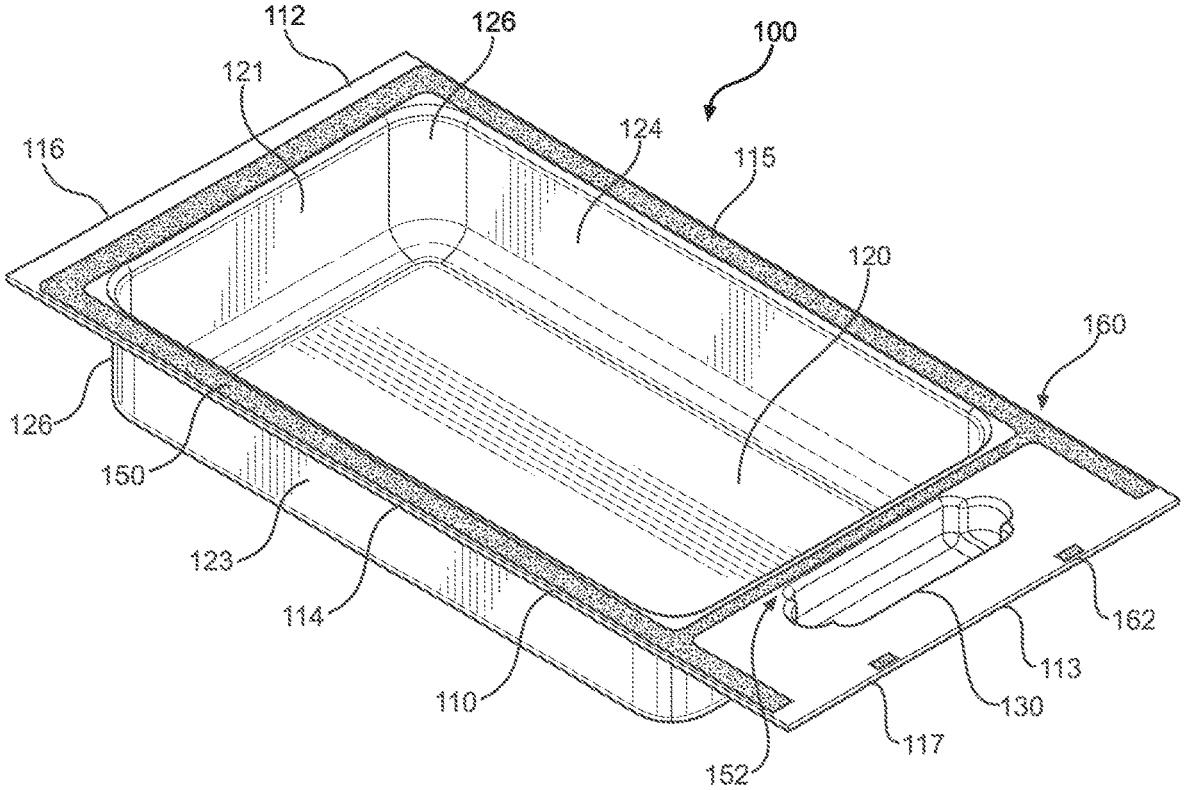
FIG. 1 illustrates a top perspective view of a dual cavity tray according to an embodiment of the present invention.
Figure 2:
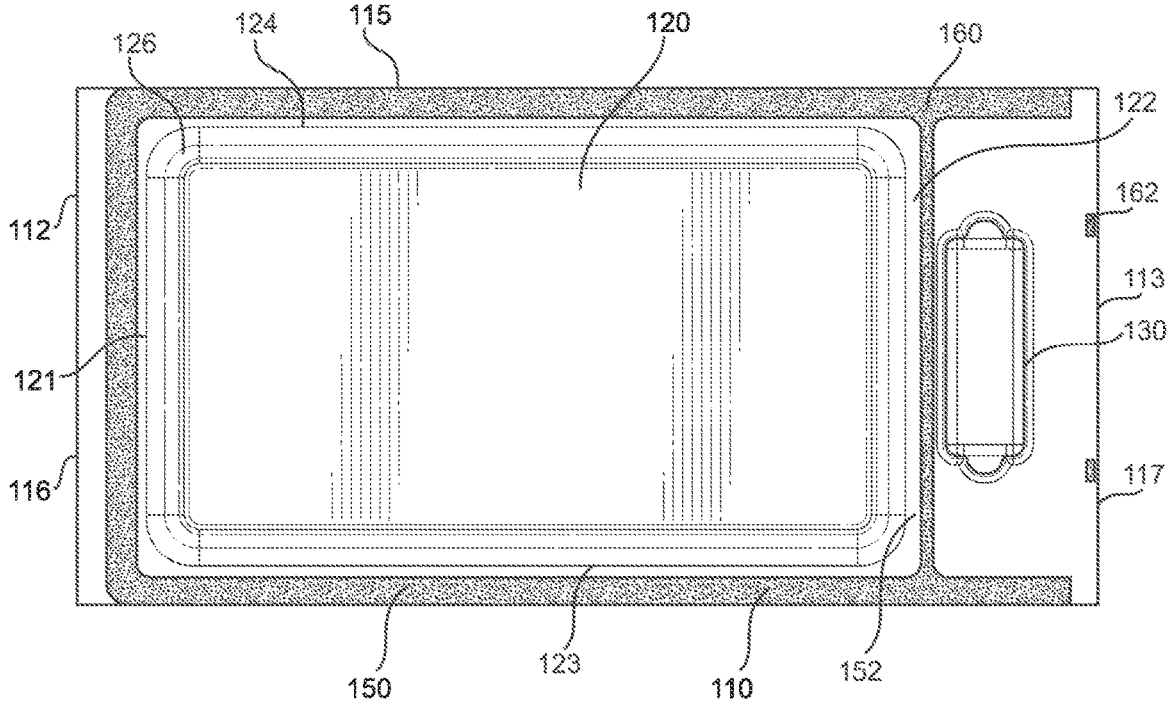
FIG. 2 illustrates a top plan view of the dual cavity tray of FIG. 1.
Figure 3:
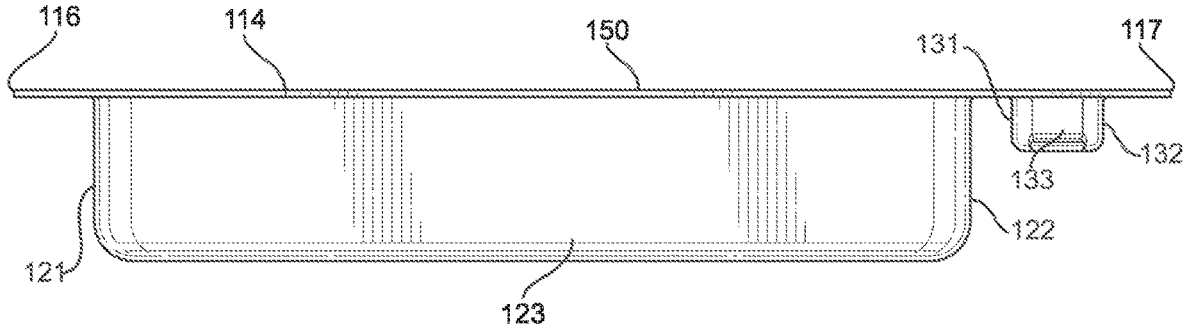
FIG. 3 illustrates a side view the dual cavity tray of FIG. 1.

The present invention describes a package for a medical kit, and a product marrying process for packaging components of the medical kit. An example of such a package in accordance with the present invention is depicted in FIGS. 1-3. The package 100 comprises a tray 110 having a first end 112 and a second end 113 spaced apart from the first end. The tray may also be referred to as blister tray. The tray further has a first side 114, and a second side 115 spaced apart from the first side. Both the first and second sides 114, 115 extend from the first end 112 of the tray to the second end 113 of the tray. The tray 110 includes a first or primary compartment 120 configured to receive a first component 20, such as one or more medical devices. The tray further includes a second or secondary compartment 130 configured to receive a second component 30, such as a medication container. For instance, the first compartment may receive an epidural catheter kit, and the second compartment may receive an epidural medication container. Other types of medical devices and medication containers may be respectively received in the first and second compartments. According to some implementations, the tray may be flexible. According to other implementations, the tray may be rigid.

Figure 4:
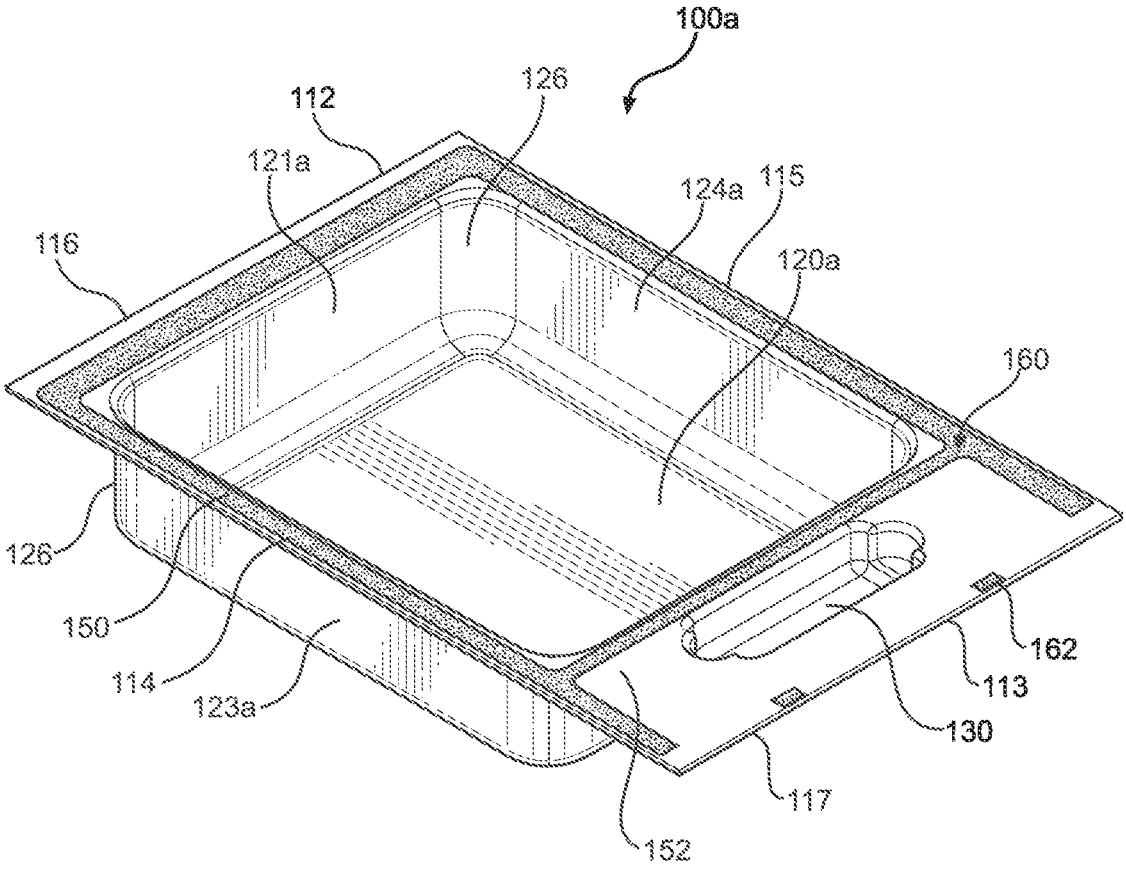
FIG. 4 illustrates a top perspective view of a dual cavity tray according to another embodiment of the present invention.
Figure 5:
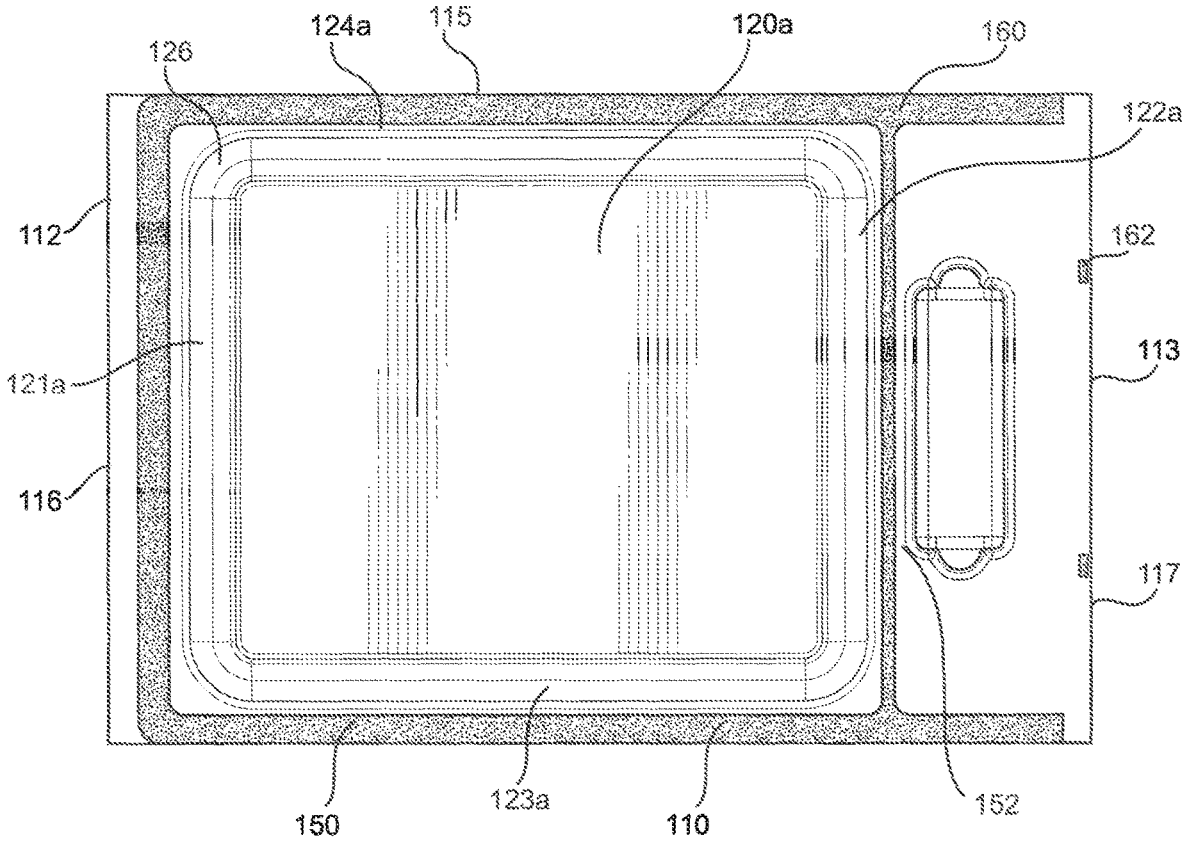
FIG. 5 illustrates a top plan view of the dual cavity tray of FIG. 4.
Figure 6:
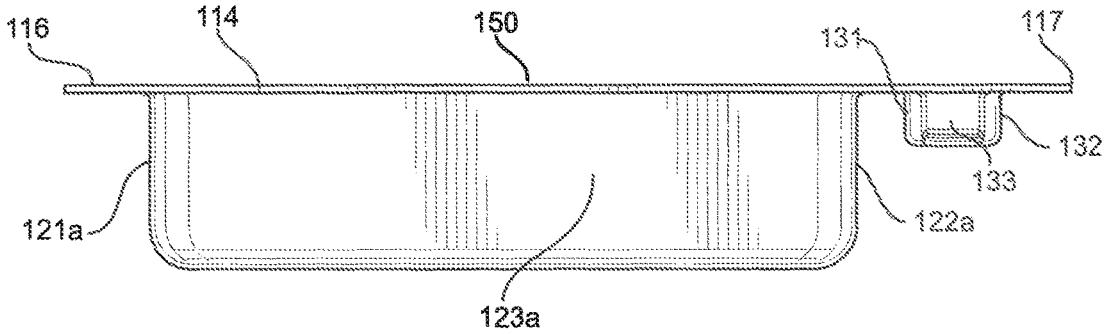
FIG. 6 illustrates a side view the dual cavity tray of FIG. 4.

The first compartment 120 is proximate to the first end 112 of the tray 110, and the second compartment 130 is proximate to the second end 113 of the tray 110. Moreover, the second compartment 130 is adjacent to the first compartment 120. The first compartment 120 defines a first or primary recessed cavity having a pair of spaced apart end walls 121, 122 and a pair of spaced apart side walls 123, 124. A depth of the first recessed cavity may vary depending on the size of a medical device received therein. In some implementations, a base of the first recessed cavity may have a generally rectangular shape, as depicted in FIGS. 1-3. In some aspects, one or more corners 126 of the first recessed cavity may be rounded or curved. In other implementations, the base of the first recessed cavity may have a generally square, triangular, trapezoidal, circular, or oval shape, among others. For instance, FIGS. 4-6 depict a tray 100*a* including a first compartment 120*a* defining a first or primary recessed cavity having a pair of spaced apart end walls 121*a*, 122*a* and a pair of spaced apart side walls 123*a*, 124*a*, wherein the base of the first recessed cavity has a generally square shape.

The second compartment 130 defines a second or secondary recessed cavity having a pair of spaced apart end walls 131, 132 and a pair of spaced apart side walls 133, 134. A depth of the second recessed cavity may vary depending on the size of a medication container received therein. The first recessed cavity is larger than then second recessed cavity. As shown in FIG. 3, for instance, the depth of the second recessed cavity is less than the depth of the first recessed cavity. In other implementations, the first recessed cavity may be smaller than then second recessed cavity. In still other implementations, the first and second recessed cavities may be the same size and/or shape.

The depth of the first and second recessed cavities may be based on the tooling used during manufacturing or molding of the tray 110. A base of the second recessed cavity may have a generally rectangular or square shape, among other shapes. In some aspects, one or more corners of the second recessed cavity may be rounded or curved. In other aspects, the side walls 133, 134 of the second cavity may by concave or bulbous to provide extra space for the medication container or other medical device component. Such concave side walls may also allow a user to insert a finger into the second cavity to assist with removal of the medication container from the second cavity during a medical procedure.

A cover sheet or lid 140 is configured to cover and seal both the first and second compartments. The cover sheet may be made from a flexible and peelable material that is strong enough to withstand accidental tearing or puncturing during handling or transport of the package. For medical applications, an example of a preferred cover sheet material is a polymeric sheet material, such as spun bond polyolefin or Tyvek®.

The cover sheet 140 is heat-sealed to a rim 150 of the tray during a package sealing operation, including the product marrying process. In some implementations, a portion of the cover sheet may be coated with a heat-sealable coating, such as a hot melt adhesive. The bottom tray may be made of a thermoformable material, such as a thermoplastic, which is capable of being heat sealed to the heat-sealable coating of the cover sheet. In other implementations, the tray may be coated with the heat-sealable coating for being heat sealed to the cover sheet. For medical applications, the tray may be made from a clear or opaque plastic. According to other aspects, the tray may be rigid or flexible.

The rim 150 extends continuously along a periphery of the tray 110 and surrounds both the first compartment 120 and the second compartment 130. In some aspects, the rim 150 may include an outwardly extending flange which increases the surface area of the seal formed with the cover sheet. The cover sheet 140 may be sized to correspond to the rim 150 of the tray. For instance, a length of the cover sheet 140 may correspond with a length of the rim 150 along the first 114 and second 115 sides of the tray extending from the first end 112 of the tray to the second end 113 of the tray. In some aspects, the length of the cover sheet 140 may be greater than the length of the rim 150 along the first 114 and second 115 sides of the tray. Further, a width of the cover sheet 140 may correspond with a width of the rim 150 along the first 112 and second 113 ends of the tray extending from the first side 114 of the tray to the second side 115 of the tray. In some aspects, the width of the cover sheet 140 may be greater than the width of the rim 150 along the first 112 and second 113 ends of the tray.

The tray 110 includes a narrow land section 152 disposed between the first compartment 120 and the second compartment 130. The land section 152 extends from a portion of the rim 150 at the first side 114 of the tray to a portion of the rim at the second side 115 of the tray. Thus, the narrow land section 152 separates the first compartment 120 from the second compartment 130. This separation formed by the land section helps maintain sterility of the first and second components when they are sealed within the respective first and second compartments. For instance, the land section 152 also helps protect the primary cavity from potential contamination from the secondary cavity when the secondary cavity includes a non-sterile component.

The cover sheet 140 is heat-sealed to a portion of the rim 150 of the tray 110 by a primary seal 160 and a secondary seal 170 that are applied at different stages of the product marrying process. For instance, during the product marrying process, the primary seal 160 is formed before the secondary seal 170 is formed, as will be further described in detail below. The primary seal 160 is formed on the rim 150 at the first end 112 of the tray and extends from the first side 114 of the tray to the second side 115 of the tray. The primary seal 160 is also formed on the rim 150 at the first side 114 of the tray and extends from the first end 112 of the tray to the second end 113 of the tray. Similarly, the primary seal 160 is further formed on the rim 150 at the second side 115 of the tray and extends from the first end 112 of the tray to the second end 113 of the tray.

Additionally, the primary seal 160 is formed on the land section 152 extending from a portion of the rim 150 at the first side 114 of the tray to a portion of the rim at the second side 115 of the tray. In this regard, the primary seal 160 formed between the tray 110 and the cover sheet 140 generally resembles an H-shape having a closed-off bottom portion, where the closed-off bottom portion corresponds to the portion of the primary seal formed on the rim 150 of the tray along the first end 112 of the tray, where the cross-bar section of the H-shape corresponds to the portion of the primary seal formed on the land section 152 of the tray, and where each extended side of the H-shape respectively corresponds to the portion of the primary seal formed on the rim of the tray along the first and second sides 114, 115 of the tray. Such a seal design may also be referred to as a legged seal, a dual-cavity legged seal, or an extended bar seal, among others. Accordingly, the primary seal 160 fully surrounds or seals the first compartment 120 and partially surrounds or seals the second compartment 130. In some aspects, a width of the primary seal along the rim 150 may be continuously uniform, while a width of the primary seal along the land section 152 of the tray may be less than the width of the primary seal along the rim. In other aspects, the width of the primary seal may be continuously uniform along the rim and the land section of the tray.

The secondary seal 170 is formed on the rim 150 at the second end 113 of the tray and extends from the first side 114 of the tray to the second side 115 of the tray. In some aspects, a portion of the secondary seal 170 may overlap corresponding portions of the primary seal 160 at the first and second sides 114, 115 of the tray. The secondary seal 170 complements the primary seal 160 to fully surround or seal the second compartment 130. In some aspects, a width of the secondary seal may be approximately the same width as the primary seal along the rim. A bar sealer may be used to apply the secondary seal 170. In some implementations, a tray sealer may be used to apply the secondary seal.

The rim 150 includes a first edge 116 at the first end 112 of the tray. The first edge 116 of the rim extends from the first side 114 of the tray to the second side 115 of the tray. Furthermore, the first edge 116 of the rim is adjacent to the primary seal 160 formed between the tray and the cover sheet. As such, the first edge 116 of the rim is not sealed by the primary seal 160 during the product marrying process. In other words, the first edge 116 of the rim remains unsealed when the cover sheet 140 is heat-sealed to the tray 110 to form the primary seal 160 during the product marrying process.

The first edge 116 of the rim remains unsealed so that a corresponding first edge of the cover sheet 140 forms a first flap over the unsealed portion of the rim for ease of opening. For instance, a user is able to grasp the first flap of the cover sheet by pulling it away from the tray, thus unsealing the primary seal to access the first compartment 120 from the first end 112 of the tray. Continued pulling of the cover sheet allows the user to completely remove the cover sheet from the tray if desired. In some aspects, a width of the first flap may be approximately 0.75 inches. In other aspects, a width of the first flap may be approximately 0.875 inches. The first flap may be larger or smaller depending on the size of the tray in order to adjust the amount of grip area. For instance, the first flap may be greater than the aforementioned dimensions to ensure the user is able to easily grip the overhang portion of the flap. In some aspects, one or more corners of the first edge 116 of the rim 150 may be chamfered to make it easier for the user to grasp the first flap and initiate peeling the sealed cover sheet off of the tray. For instance, the cover sheet may overhang the tray to create a flap which the user may grip to facilitate separating the cover sheet from the tray. The overhang portion of the cover sheet may also include a fold-down or hang-down portion on which identifying indicia may be printed. Such identifying indica may include information about the medical device components and/or the medication stored in the tray. In some implementations, the identifying indicia may be color coded for quick reference.

The rim 150 includes a second edge 117 at the second end 115 of the tray. The second edge 117 of the rim extends from the first side 114 of the tray to the second side 115 of the tray. The second edge 117 of the rim is adjacent to the secondary seal 170 formed between the tray and the cover sheet. As such, the second edge 117 of the rim is not sealed by the secondary seal 170 during the product marrying process. In other words, the second edge 117 of the rim remains unsealed when the cover sheet 140 is heat-sealed to the tray 110 to form the secondary seal 170 during the product marrying process. The second edge 117 of the rim remains unsealed so that a corresponding second edge of the cover sheet forms a second flap over the unsealed portion of the rim for ease of opening. Specifically, a user is able to grasp the second edge of the cover sheet by pulling it away from the tray, thus unsealing the secondary seal to access the second compartment 130. Continued pulling of the cover sheet allows the user to completely remove the cover sheet from the tray. In some aspects, a width of the second flap may be approximately 0.75 inches. In other aspects, a width of the second flap may be approximately 0.875 inches. In some aspects, one or more corners of the second edge 117 of the rim 150 may be chamfered to make it easier for the user to grasp the second flap and initiate peeling the sealed cover sheet off of the tray. The second flap may be larger or smaller depending on the size of the tray in order to adjust the amount of grip area. For instance, the second flap may be greater than the aforementioned dimensions to ensure the user is able to easily grip the overhang portion of the flap Both the first and second flaps of the cover sheet allow the user the ability to open the package from the first end 112 of the tray and/or the second end 113 of the tray. Additionally, one or more tack seals 162 may be applied to the second edge 117 of the rim for temporarily securing the second edge of the cover sheet to the tray to prevent the second flap formed by the second edge of the cover sheet from inadvertently opening prior to filling the second compartment during the product marrying process.

Figure 7:
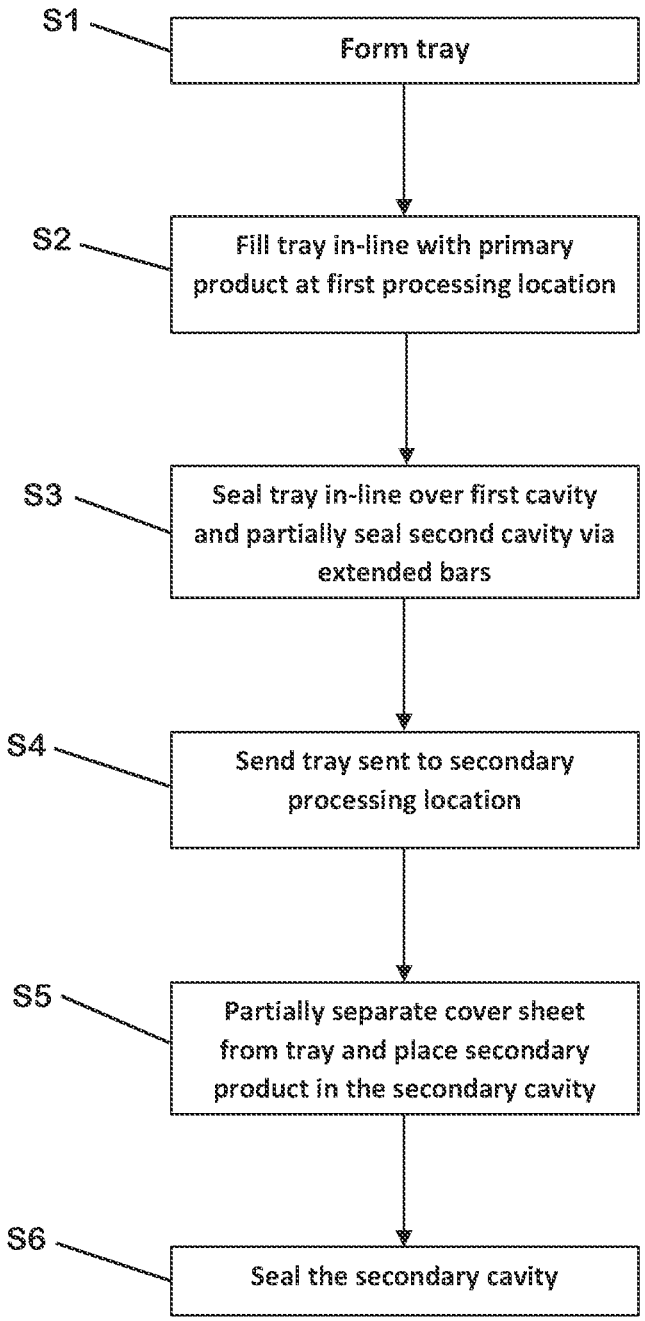
FIG. 7 illustrates a flow chart depicting steps of a product marrying process according to the present invention.

A product marrying process for packaging components of a medical kit is depicted in FIG. 7. In a first step S1 of the process, a tray or pouch is formed at a first manufacturing location or facility by molding a thermoplastic material into the desired shape. As described in detail above, such a tray 110 may include first 120 and second 130 compartments surrounded by a continuous rim 150 defining an outwardly extending flange. The bottom tray may be made of a thermoplastic material capable of being heat sealed to a cover sheet. In some applications, the tray may be made from a clear plastic so that a user is able to inspect the contents of the various compartments without opening the package.

Figure 8:
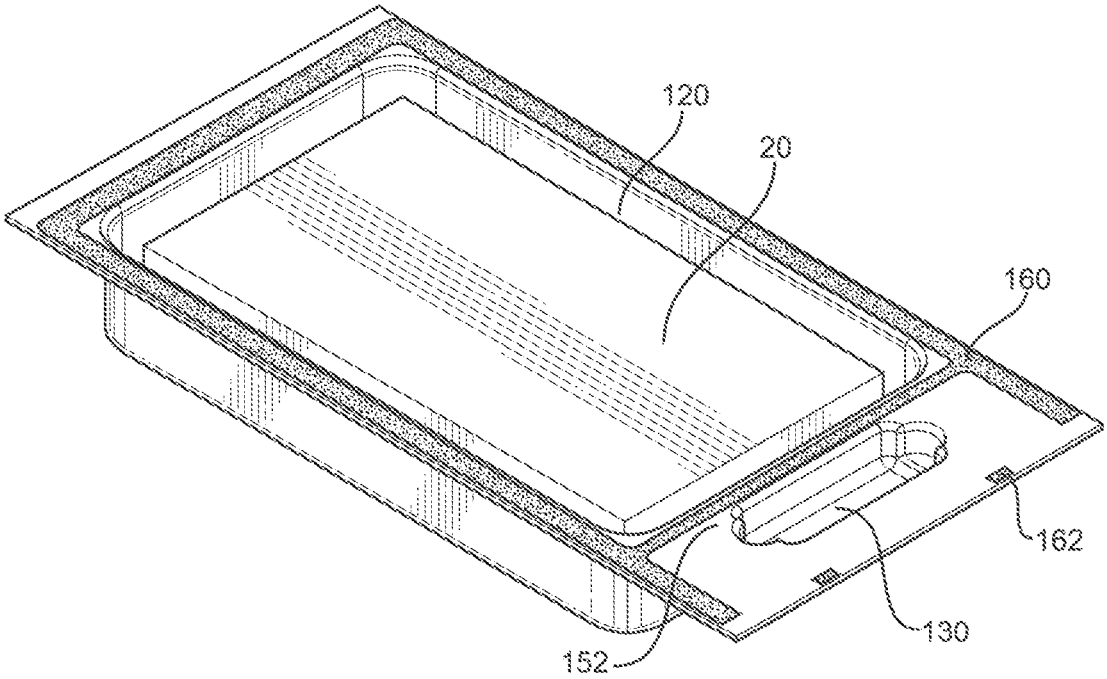
FIG. 8 illustrates the step of filling a first compartment of the tray with a first component during the product marrying process.

In a second step S2 of the process, the first compartment 120 of the tray is filled with a primary product, as depicted in FIG. 8. In some aspects, the primary product may be a medical device. Forming the tray and forming the primary seal may occur inline on a Form Fill Seal (FFS) machine, or a pre-formed dual cavity tray (i.e., formed offline) may be supplied and then the primary seal placed when the product is loaded into the first compartment.

Figure 9:
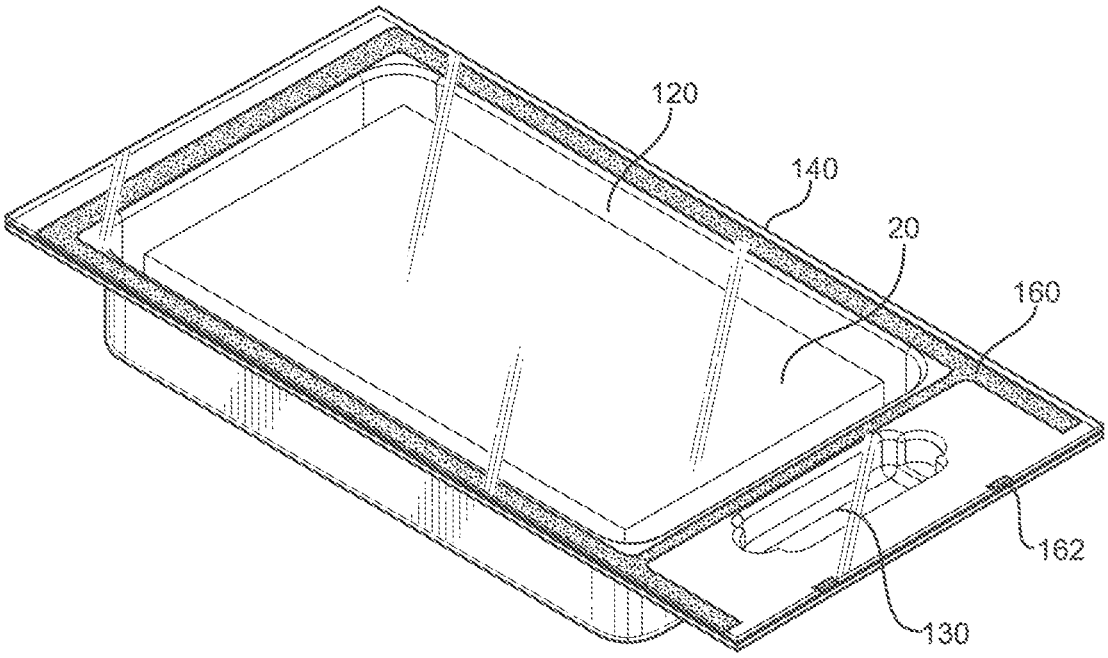
FIG. 9 illustrates the step of sealing the first compartment of the tray with a cover sheet during the product marrying process.

In a third step S3 of the process, the cover sheet 140 is applied over the tray and heat-sealed therewith. More particularly, the cover sheet 140 is heat-sealed to a portion of the rim 150 of the tray 110 to form primary seal 160 between the cover sheet and the tray. As shown in FIG. 9, the primary seal 160 is formed at the first end 112 of the tray and extends from the first side 114 of the tray to the second side 115 of the tray. The primary seal 160 is also formed on the rim 150 at the first side 114 of the tray and extends from the first end 112 of the tray to the second end 113 of the tray. Similarly, the primary seal 160 is also formed on the rim 150 at the second side 115 of the tray and extends from the first end 112 of the tray to the second end 113 of the tray. Additionally, the primary seal 160 is formed on the land section 152 extending from a portion of the rim 150 at the first side 114 of the tray to a portion of the rim at the second side 115 of the tray. The primary seal 160 does not extend along the rim at the second end 113 of the tray. Accordingly, the primary seal 160 fully surrounds or seals the first compartment 120 and only partially surrounds or seals the second compartment 130.

At least one tack seal 162 is applied between the cover sheet and the tray at or near the second edge 117 of the tray. The tack seal 162 is heat-sealed concurrently with the initial heat-sealing operation that forms the primary seal 160. For instance, the tack seal 162 may comprise a piece of sealing gasket, so that when a platen applies the primary seal 160 it also places each tack seal at the same time.

In a fourth step S4 of the product marrying process, the package 100 is sent to a secondary processing location for filling the second compartment. This secondary processing location may be another fill line in the same facility in which the first compartment was filled. Alternatively, the secondary processing location may be at an entirely different facility. In another implementation, the second compartment may be filled at the first processing location but at a time after the first compartment has already been filled with the primary product. The aforementioned tack seal 162 prevents the portion of the cover sheet over the second edge 117 of the tray from completely opening up during transit to the secondary processing location.

Figure 10:
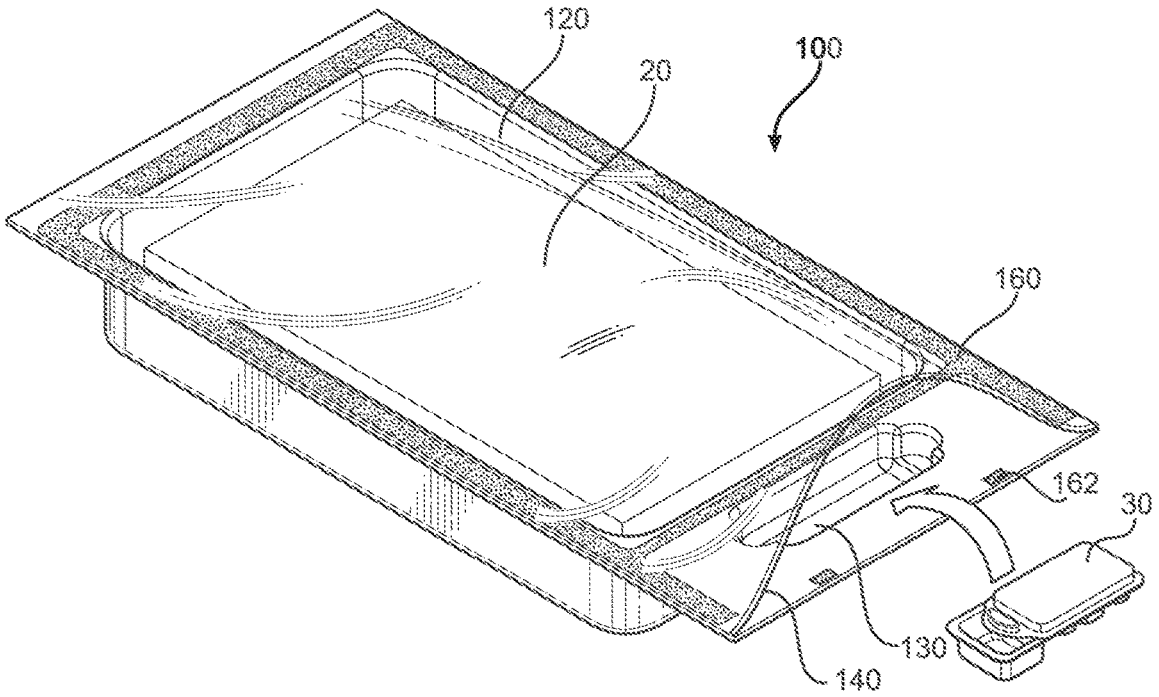
FIG. 10 illustrates the step of filling a second compartment of the tray with a second component during the product marrying process.

In a fifth step S5 of the process, the second end of the cover sheet is lifted away from the second edge 117 of the tray such that the tack seal 162 between the cover sheet and the tray is unsealed while the primary seal 160 remains sealed. Thus, to add a product to the second compartment, the flap of the lid is separated from the tray at the unsealed side of the tray, by separating any tack seals without separating the primary seal, to gain full access to the second cavity and introduce the second component therein. Lifting the second end of the cover sheet provides access to the second compartment of the tray. As shown in FIG. 10, a secondary product, such as a medication container, is then inserted into the second compartment of the tray.

Figure 11:
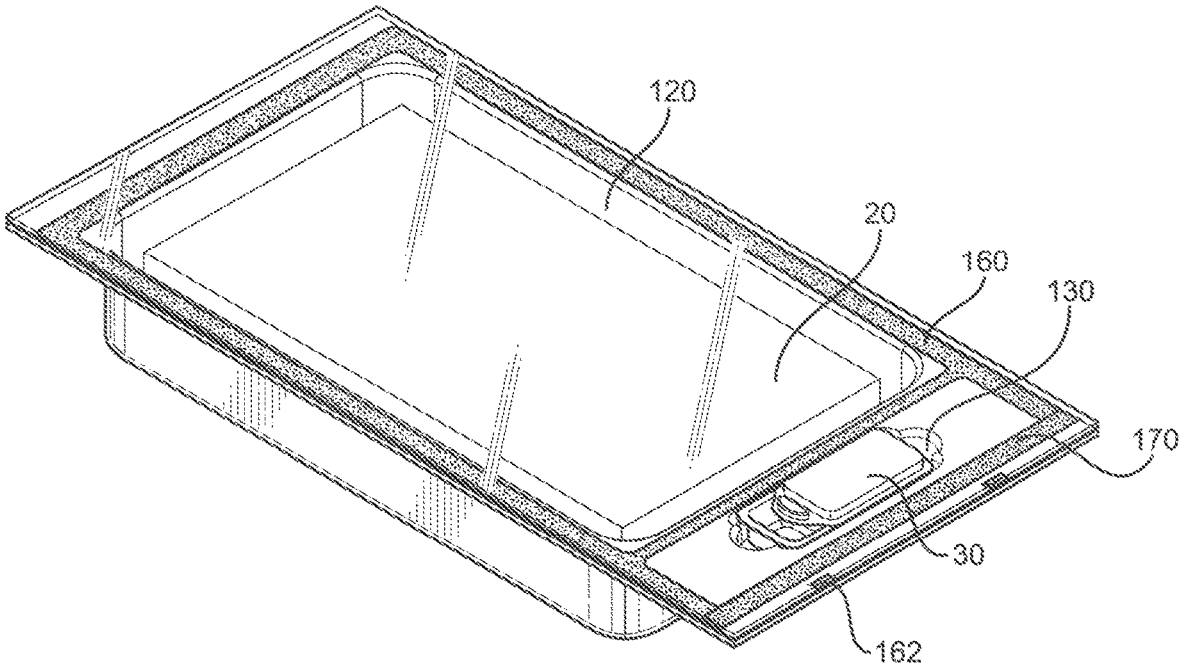
FIG. 11 illustrates the step of sealing the second compartment of the tray with a second component during the product marrying process.

In a final step S6 of the product marrying process, the portion of the cover sheet covering the second compartment is flattened and sealed by applying a secondary seal 170 along the rim 150 at the second end 113 of the tray, as shown in FIG. 11. A sealer, such as bar sealer or a tray sealer, may be used to from the secondary seal 170 to enclose the second cavity. A portion of the secondary seal 170 may overlap corresponding portions of the primary seal 160 at the first and second sides 114, 115 of the tray. The packaged products are then handled as a single sterile barrier or packaging system so they may be sterilized together. Moreover, an end user is able to open the package as a single packaging system. For instance, the package may be opened at either end so that the user can access the primary product without having to open and expose the secondary cavity, and vice versa. In other aspects, the package may be opened at both end so that the user can access the primary product and the secondary product at the same time.

While a package for a medical kit, and a product marrying process for packaging components of the medical kit, have been described in terms of what may be considered to be specific aspects, the present invention is not limited to the disclosed aspects. Additional modifications and improvements to the present invention may be apparent to those skilled in the art. Moreover, the many features and advantages of the disclosure are apparent from the detailed specification, and thus, it is intended by the appended claims to cover all such features and advantages of the present invention which fall within the spirit and scope of the disclosure. Further, it is not desired to limit the disclosure to the exact construction and operation illustrated and described, and accordingly, all suitable modifications and equivalents may be resorted to, falling within the scope of the disclosure. The present disclosure should therefore be considered as illustrative and not restrictive. As such, this disclosure is intended to cover various modifications and similar arrangements included within the spirit and scope of the claims, which should be accorded their broadest interpretation so as to encompass all such modifications and similar structures.

What is claimed is:

1. A product marrying process, comprising:

providing a tray at a first processing location, the tray including a first compartment proximate to a first end of the tray, a second compartment proximate to a second end of the tray, and a rim surrounding the first and second compartments;

filling the first compartment of the tray with a first component;

placing a flexible cover sheet over the first and second compartments of the tray;

forming a primary seal between the cover sheet and the tray by heat-sealing the cover sheet to the rim of the tray, wherein the primary seal surrounds the first compartment such that the first compartment is sealed by the primary seal, and the primary seal extends along two opposing sides of the second compartment such that the second compartment is partially sealed by the primary seal;

sending the tray to a second processing location;

filling the second compartment of the tray with a second component; and forming a secondary seal between the cover sheet and the tray by heat-sealing the cover sheet to the rim at the second end of the tray such that the secondary seal complements the primary seal to seal the second compartment.

2. The product marrying process according to claim 1, wherein the primary seal is formed on the rim at a first side of the tray and extends from the first end of the tray to the second end of the tray, and wherein the primary seal is further formed on the rim at the second side of the tray and extends from the first end of the tray to the second end of the tray.

3. The product marrying process according claim 1, wherein the primary seal is formed on the rim at the first end of the tray and extends from the first side of the tray to the second side of the tray.

4. The product marrying process according to claim 1, wherein the secondary seal is formed on the rim at the second end of the tray and extends from a first side of the tray to a second side of the tray.

5. The product marrying process according to claim 1, wherein the first component includes a medical device.

6. The product marrying process according to claim 1, wherein the second component includes a medication container.

7. The product marrying process according to claim 1, wherein a first edge at the first end of the tray is unsealed after the primary seal is formed such that a first edge of the cover sheet forms a first unsealed flap over the corresponding first edge of the tray.

8. The product marrying process according to claim 7, wherein a second edge at the second end of the tray is unsealed after the secondary seal is formed such that a second edge of the cover sheet forms a second unsealed flap over the corresponding second edge of the tray.

* * * * *